US009199783B2

(12) United States Patent
Wanbaugh et al.

(10) Patent No.: US 9,199,783 B2
(45) Date of Patent: Dec. 1, 2015

(54) PLASTIC VALVES AND METHODS OF USING THE SAME

(75) Inventors: Linn D. Wanbaugh, Blue Springs, MO (US); David L. DeJong, Ogden, UT (US)

(73) Assignee: WestRock Dispensing Systems, Inc., Norcross, GA (US)

( * ) Notice: Subject to any disclaimer, the term of this patent is extended or adjusted under 35 U.S.C. 154(b) by 1055 days.

(21) Appl. No.: 12/675,506

(22) PCT Filed: Aug. 28, 2008

(86) PCT No.: PCT/US2008/074650
§ 371 (c)(1),
(2), (4) Date: Jan. 10, 2011

(87) PCT Pub. No.: WO2009/032762
PCT Pub. Date: Mar. 12, 2009

(65) Prior Publication Data

US 2011/0101036 A1 May 5, 2011

Related U.S. Application Data

(60) Provisional application No. 60/968,365, filed on Aug. 28, 2007, provisional application No. 60/980,270, filed on Oct. 16, 2007, provisional application No. 61/041,491, filed on Apr. 1, 2008.

(51) Int. Cl.

| | |
|---|---|
| ***B65D 83/00*** | (2006.01) |
| ***B65D 83/22*** | (2006.01) |
| ***B05B 11/00*** | (2006.01) |
| ***B65D 83/38*** | (2006.01) |
| ***B65D 83/42*** | (2006.01) |
| ***B65D 83/48*** | (2006.01) |
| *B65D 83/62* | (2006.01) |

(52) U.S. Cl.
CPC ..... *B65D 83/226* (2013.01); *B05B 11/3047* (2013.01); *B65D 83/38* (2013.01); *B65D 83/425* (2013.01); *B65D 83/48* (2013.01); *B65D 83/62* (2013.01); *Y10T 29/49947* (2015.01)

(58) Field of Classification Search
CPC .... B65D 83/226; B65D 83/38; B65D 83/425; B65D 83/48; B05B 11/3047
USPC ..... 222/153.09, 402.1; 220/203.19, 203.01, 220/324, 326, 203.22, 315; 215/280, 281, 215/273, 315, 311
See application file for complete search history.

(56) References Cited

U.S. PATENT DOCUMENTS 1,609,453 A 7/1924 Atwood
2,723,773 A * 11/1955 Greene ..... 215/29
(Continued)

FOREIGN PATENT DOCUMENTS

FR 2508136 12/1982
FR 2508136 A * 12/1982 ..... F16K 21/04
(Continued)

*Primary Examiner* — Patrick M Buechner
*Assistant Examiner* — Jeremy W Carroll
(74) *Attorney, Agent, or Firm* — WestRock Intellectual Property Group

(57) ABSTRACT

Snap fitment systems (500) and valve systems (200, 800) for holding valves, pumps, sprayers, or other devices to a container (100) may include plastic components which snap to a container allowing the valve system to be used to evacuate product in the container or allowing the valve system to be used to fill and evacuate product in the container.

16 Claims, 9 Drawing Sheets

(56) References Cited

U.S. PATENT DOCUMENTS

| | | | | | |
|---|---|---|---|---|---|
| 2,865,525 | A | | 12/1958 | Satz | |
| 3,161,330 | A | * | 12/1964 | Sagarin et al. | 222/402.24 |
| 3,799,392 | A | | 3/1974 | Richards | |
| 3,810,558 | A | * | 5/1974 | Crisp et al. | 215/21 |
| 3,863,798 | A | | 2/1975 | Kurihara | |
| 4,211,333 | A | | 7/1980 | Villarejos | |
| 4,251,003 | A | | 2/1981 | Bodenmann | |
| 4,773,553 | A | | 9/1988 | Van Brocklin | |
| 5,209,362 | A | | 5/1993 | Lutzker | |
| 5,299,703 | A | | 4/1994 | Cater | |
| 5,314,084 | A | | 5/1994 | Folta et al. | |
| 5,326,002 | A | | 7/1994 | Dubini | |
| 5,348,174 | A | * | 9/1994 | Velicka | 215/277 |
| 5,560,520 | A | * | 10/1996 | Grogen | 222/321.2 |
| 5,562,219 | A | * | 10/1996 | de Pous et al. | 215/274 |
| 5,762,238 | A | | 6/1998 | Liang | |
| 5,772,080 | A | | 6/1998 | de Pous et al. | |
| 5,791,524 | A | * | 8/1998 | Demarest | 222/153.06 |
| 5,890,610 | A | | 4/1999 | Jansen et al. | |
| 6,186,364 | B1 | * | 2/2001 | Dobbs | 222/153.13 |
| 6,247,613 | B1 | * | 6/2001 | Meshberg | 222/1 |
| 6,253,941 | B1 | | 7/2001 | VanBrocklin et al. | |
| 6,409,049 | B1 | | 6/2002 | de Pous et al. | |
| 6,543,648 | B2 | * | 4/2003 | de Pous et al. | 222/153.09 |
| 6,772,913 | B2 | * | 8/2004 | Garcia et al. | 222/153.09 |
| 6,776,311 | B2 | | 8/2004 | Ackermann | |
| 7,007,523 | B2 | | 3/2006 | Belden, Jr. | |
| 7,011,236 | B2 | * | 3/2006 | VanBrocklin | 222/321.9 |
| 7,845,505 | B2 | | 12/2010 | Hamamoto et al. | |
| RE42,553 | E | | 7/2011 | de Pous et al. | |
| 2001/0054624 | A1 | | 12/2001 | Jourdin et al. | |
| 2002/0104853 | A1 | | 8/2002 | Rosa | |
| 2010/0243599 | A1 | * | 9/2010 | Chae | 215/274 |

FOREIGN PATENT DOCUMENTS

| | | |
|---|---|---|
| FR | 2893592 | 5/2007 |
| GB | 2274836 | 8/1994 |

* cited by examiner

PLASTIC VALVES AND METHODS OF USING THE SAME

CROSS-REFERENCE TO RELATED APPLICATIONS

This application claims the benefit of U.S. Provisional Application No. 60/968,365, entitled "BOTTLE AND CAP FITMENT AND METHODS OF USING THE SAME," filed Aug. 28, 2007, and U.S. Provisional Application No. 60/980,270, entitled "PLASTIC VALVES AND METHODS OF USING THE SAME," filed Oct. 16, 2007, and U.S. Provisional Application No. 61/041,491, entitled "PLASTIC VALVES AND METHODS OF USING THE SAME," filed Apr. 1, 2008, and International Application Number PCT/US08/74650, entitled "PLASTIC VALVES AND METHODS OF USING THE SAME," filed Aug. 28, 2008, and incorporates each herein by reference in their entirety.

BACKGROUND OF THE INVENTION

1. Field of the Invention

Embodiments of the invention relate to snap fitment systems and valve systems for pressurized or non-pressurized containers and more particularly to plastic snap fitment systems and valve systems for use with aerosol systems or the like.

2. State of the Art

Pressurized bottles and containers are used in many different industries. One of the most widely known uses of pressurized bottles in commercial markets includes aerosol bottles and containers. Aerosol bottles and containers generally hold pressurized gases, gases and liquids, or liquids.

Conventional aerosol bottles are constructed of one or more metals and are typically found in a cylindrical shape which may assist in supporting the pressure inside the aerosol bottle. Closure fitments, such as pumps, valves, triggers, or other devices may be attached to an aerosol bottle to close the bottle. The closure fitments are typically sealed to the rim or neck of the aerosol bottle such that they cannot be easily removed.

Increasing costs of metal and difficulties in recycling pressurized metal containers have made it desirable to develop other types of containers, such as plastic containers, and closures systems for such containers. However, the mixture of plastic and metal parts in valve systems for such containers may be undesirable. Trends in sustainability of resources have also increased the desire to produce commercial components that are recyclable. Therefore, it would be advantageous to develop closures and valve systems that may be used with plastic bottles or containers and especially with plastic bottles or containers that may be pressurized or used for aerosol delivery systems. It may also be desirable to produce an all plastic closure and/or valve system for such containers.

SUMMARY OF THE INVENTION

According to embodiments of the invention, a snap fitment system may be used to connect a valve, pump, spray device, or other device to a container such as a bottle. The snap fitment system may include one or more compression latches incorporated with a valve body. The compression latches may extend or flex to allow the snap fitment system to fit over a container and may snap into place with a corresponding fitment on the container. The compression latches may secure the snap fitment system to the container such that once the compression latches have engaged a portion of the container the snap fitment system is difficult to remove from the container.

According to other embodiments of the invention, a valve system may include a valve body, a valve housing, an upper valve stem and a lower valve stem. The valve body may be connected to the valve housing, forming an interior space between the valve body and valve housing. The upper valve stem may extend through the valve body and partially into the interior space formed by the valve body and the valve housing. The lower stem may be contained within the interior space as well and may be in contact with the upper stem. Compression of the upper stem may move the lower stem in the interior space. One or more ribs or other features in the valve housing may break a seal between the lower stem and an interior surface of the valve housing, allowing product to escape through the valve. According to embodiments of the invention, the valve system may be attached to a container such as an aerosol container.

In still other embodiments of the invention, a valve system may include a valve housing and valve body integrated in a single piece. A top retainer may be assembled with the valve body and may enclose an upper valve stem and a lower valve stem in the valve body. Activation of the upper valve stem may break one or more seals in the valve system, allowing product to pass through the valve.

According to other embodiments of the invention, the valve body may include an interior space for receiving a portion of an upper valve stem and a lower valve stem. The valve system may be connected to a container and pressure in the container may prevent the valve stems from falling out of the valve body. In some embodiments of the invention, pressure from inside the container exerts a force on the lower stem, keeping the lower stem in a sealing position with respect to the valve body until a force acting on the upper valve stem moves the lower valve stem over one or more seal breaking features, allowing product to escape from the container through the valve system. In other embodiments, a tube retainer or other device may be used to close the interior space of the valve body and help to retain the valve stems.

According to other embodiments of the invention, a valve system may be configured such that the valve system may be attached to a container before filling, pressurizing, or both filling and pressurizing the container to which the valve system is attached. In some embodiments of the invention, a valve body and a retainer may be connected, the valve body including a stem at least partially in an interior space of the valve body and the retainer supporting a fill valve. Pressure applied to the stem may act to open the fill valve allowing a container to be filled or pressurized.

In still other embodiments of the invention, snap fitment systems and valve systems according to embodiments of the invention may be formed of plastic and may be used with plastic containers, providing all-plastic alternatives to conventional valve systems.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention, a snap fitment system may be used to attach a closure, pump, trigger, or other device to a pressurized bottle. While various embodiments of the invention are described with respect to a closure being attached to a bottle or container, it is understood that a closure may include, but is not limited to, pumps, triggers, distribution means, valves, or other devices.

Figure 1:
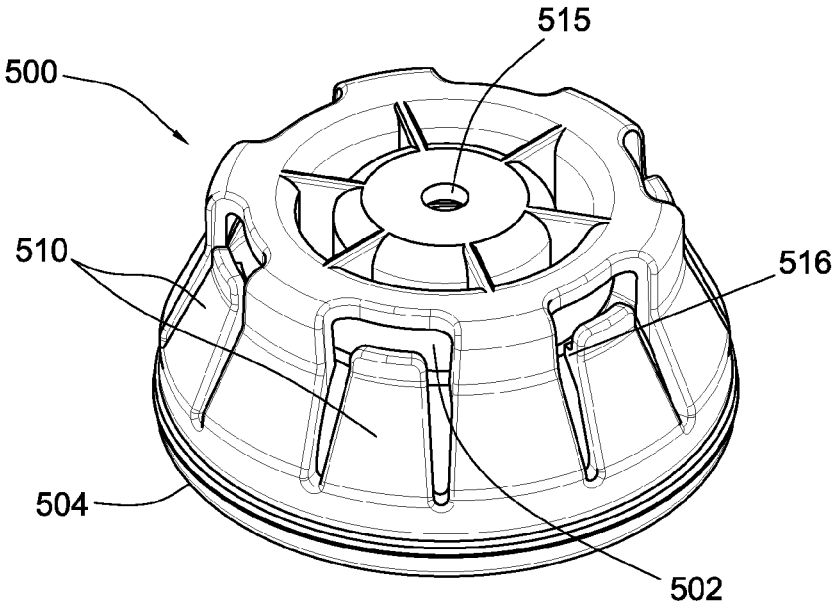
FIG. 1 illustrates a snap fitment system according to embodiments of the invention.

According to embodiments of the invention, a snap fitment system may include a valve body 500 attached to a bottle 100. In some embodiments of the invention, a valve body 500 may include one or more compression latches 510 incorporated with the valve body 500 as illustrated in FIG. 1. The valve body 500 may retain a valve in a valve opening 515 in a conventional manner or according to retention methods used with other embodiments of the invention.

Figure 2:
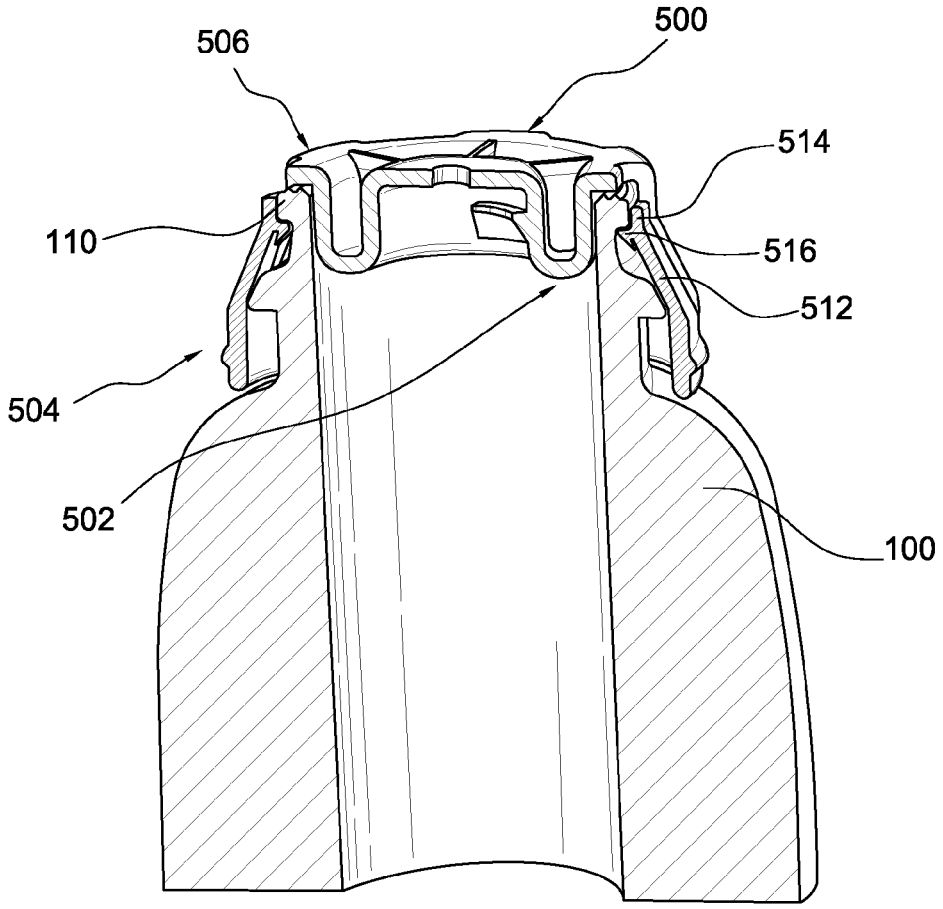
FIG. 2 illustrates a snap fitment system according to embodiments of the invention attached to a container.

As illustrated in FIG. 1, the valve body 500 may include an interior cup 502 and an exterior skirt 504 which are connected at a valve body lip 506 such that the valve body 500 may be placed over an opening in a container 100. When placed over an opening in a container 100, an edge of the container 100 may fit between the interior cup 502 and the exterior skirt 504 such that a valve body lip 506 rests on a lip of a container 100 and the interior cup 502 is inside the opening of a container 100 and the exterior skirt 504 is outside the opening of a container 100 when the valve body 500 is mounted on a container 100. For example, FIG. 2 illustrates a cross-sectional view of a valve body 500 positioned on a container 100 according to embodiments of the invention. As illustrated in FIG. 2, the interior cup 502 of the valve body 500 is positioned inside the container 100 and the exterior skirt 504 of the valve body 500 is positioned outside of the container 100. The valve body 500 may rest on the container 100 at the valve body lip 506. In some embodiments of the invention, one or more gaskets may be placed between a valve body 500 and a container 100 when a valve body 500 is placed on the container 100.

The valve body 500 illustrated in FIG. 2 may be connected to the container 100 by the one or more compression latches 510 incorporated into the valve body 500. A compression latch 510 according to various embodiments of the invention may include one or more flexible flanges or latches extending from the base of the exterior skirt 504 towards the valve body lip 506. The one or more compression latches 510 may include compression latches 510 formed from the exterior skirt 504 portion of the valve body 500 as illustrated in FIG. 2. In other embodiments of the invention, one or more compression latches 510 may be additional components that are connected to or otherwise in communication with the exterior skirt 504 of the valve body 500.

Figure 3:
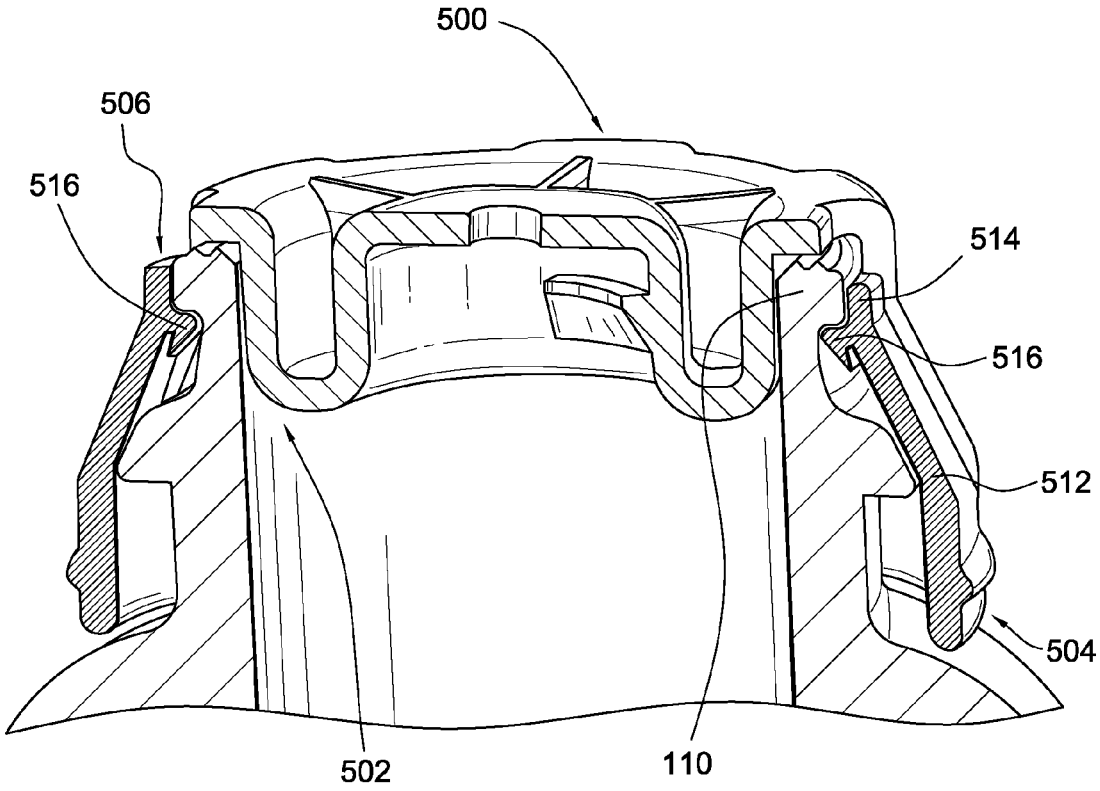
FIG. 3 illustrates a cross-sectional view of a compression latch of a snap fitment system according to embodiments of the invention.

A side cross-sectional view of a compression latch 510 according to various embodiments of the invention is illustrated in FIG. 3. The compression latch 510 may include a compression latch body 512 extending from a base of the exterior skirt 504 upwards towards the valve body lip 506. As the compression latch body 512 approaches the valve body lip 506, the compression latch body 512 terminates in a top portion 514. One or more fingers 516 extend off a back side of the compression latch body 512 towards the interior cup 502 as illustrated in FIG. 3. The joint between a finger 516 and the top portion 514 may form an angled latch area between the top portion 514 and a finger 516. In some embodiments of the invention, the compression latch body 512 may angle inwards towards the interior cup 502 as the compression latch body 512 extends from the exterior skirt 504 towards the valve body lip 506. A compression latch 510 according to embodiments of the invention may also be an integral part of the exterior skirt 504 and may be flexible such that pressure applied to the compression latch 510 may flex the compression latch body 512.

A valve body 500 according to various embodiments of the invention may be fitted to a container 100 by snapping one or more compression latches 510 over one or more container flanges 110. For example, as illustrated in FIG. 2, a container 100 may include one or more container flanges 110 on an exterior of the container 100. A valve body 500 according to embodiments of the invention may be snapped over the container 100 such that the interior cup 502 of the valve body 500 fits on an interior of the container 100 and the valve body lip 506 rests on a top portion of the container 100. As the valve body 500 is positioned over the container 100 and pressed towards the container 100, one or more compression latches 510 integrated with the valve body 500 may flex outwards from the container 100 as they pass the container flange 110. Once the container flange 110 clears the fingers 516 of the compression latch 510, the compression latch 510 may spring back into the original position such that the fingers 516 are positioned underneath the container flange 110.

Once the finger 516 of a compression latch 510 is positioned under a container flange 110 the valve body 500 may be difficult to remove from the container 100. The application of force to the bottom of the exterior skirt 504 of the valve body 500 in a direction away from the top of the container 100 may cause the container flange 110 to exert a force on the fingers 516 of the compression latch 510 which may flex the compression latch 510 and prevent the valve body 500 from being removed from the container 100. Similarly, when pressure inside the container 100 exerts a force against the interior cup 502 of the valve body 500, movement of the interior cup 502 causes flexion of a compression latch 510 creating a force between the finger 516 and the container flange 110 which force helps to retain the valve body 500 on the container 100. Thus, as pressure inside a container 100 increases, the fingers 516 of the compression latch 510 will lock to the container flange 110 with more force.

The compression latches 510 of the valve body 500 according to various embodiments of the invention may allow a plastic valve body 500 to be connected to a plastic container 100 for use with aerosol valves or pressurized containment and delivery systems. The compression latches 510 of the valve body 500 may also be used as an attachment system for non-pressurized containers 100.

According to some embodiments of the invention, the valve body 500 may include a single component as illustrated in FIG. 1. The valve body 500 may be made of any desirable material, including, but not limited to, metals, plastics, composites, or other materials. In some embodiments, the valve body 500 may include a single molded plastic or resin component. In other embodiments, the valve body 500 may include a molded plastic or resin component that includes two or more plastic or resin materials which are joined by a fusion process or by a bi-injected molding process. In still other embodiments of the invention, a valve body 500 may include more than one part.

According to embodiments of the invention, a snap-fitment system may be used to attach a closure, pump, trigger, valve or other device to a pressurized bottle. For example, in some embodiments of the invention, a valve system may be attached to a container 100 using a snap fitment system. The valve system incorporated with the snap fitment system may be a traditional valve system or may be made completely of plastic or non-metal parts.

Figure 4:
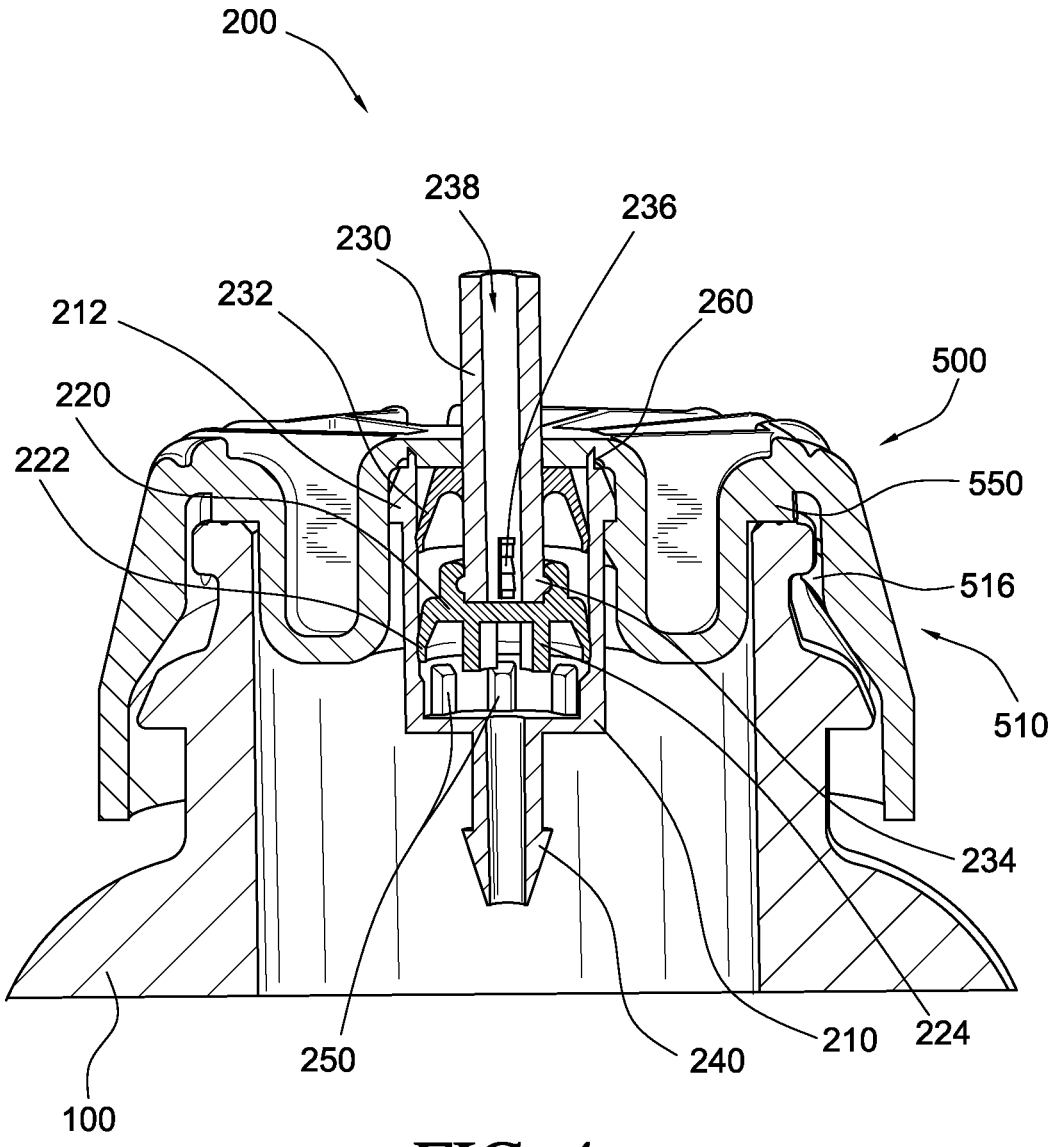
FIG. 4 illustrates a cross-sectional view of a valve system according to embodiments of the invention attached to a container with a snap-fitment valve body system.

As illustrated in FIG. 4, a valve system according to embodiments of the invention may be attached to a container 100 with a valve body 500 similar to the valve bodies 500 illustrated in FIGS. 1 through 3. One or more fingers 516 on compression latches 510 of the valve body 500 may mate with the container 100, holding the valve body 500 on the container 100 even when the container 100 is under pressure. In some embodiments of the invention, the valve body 500 may include one or more gaskets 550 between valve body 500 and the container 100 as illustrated in FIG. 4. The one or more gaskets 550 may include a gasket 550 bi-injected with the valve body 500 or a separate gasket component which may be assembled with the valve body 500 and container 100. The use of a bi-injected gasket 550 may decrease the number of assembly steps required during assembly of the valve system.

The valve system 200 illustrated in FIG. 4 may include a valve housing 210, a lower stem 220 and an upper stem 230. The valve housing 210 may be snap-fit into the valve body 500. For example, one or more valve housing latches 212 may snap-fit with corresponding fingers or latches of the valve body 500. The valve housing 210 may also include a tube connector 240 integrated with the valve housing 210 or connected to a bottom portion of the valve housing 210. The tube connector 240 may be configured to transport one or more fluids, gases, liquids, or combinations thereof, into an interior portion of the valve housing 210. The valve housing 210 may also include one or more ribs 250 within an interior of the valve housing 210. The ribs 250 may be positioned below the lower stem 220 when the lower stem is positioned in a closed position. One or more crush seals 260 may also be included with the valve housing 210 wherein the one or more crush seals 260 form a seal between an interior space of the valve housing 210 and the valve body 500.

The upper stem 230 of the valve system 200 may be positioned partially in an interior space of the valve housing 210 and partially projecting through the valve body 500 as illustrated in FIG. 4. The upper stem 230 may include an upper stem skirt seal 232 which seals with an interior wall of the valve housing 210. The upper stem 230 may also include one or more upper stem legs 234 which mate with or which are configured to mate with the lower stem 220. According to some embodiments of the invention, the upper stem legs 234 are fixably connected to the lower stem 220 and according to others, the upper stem legs 234 may interact with the lower stem 220 to move the lower stem 220 in the interior of the valve housing 210. For example, as illustrated in FIG. 4, the upper stem legs 234 mate with and are connected to the lower stem 220 such that when the upper stem 230 is moved, the lower stem 220 moves with the upper stem 230. The space between the upper stem skirt seal 232 and the lower stem 220 defines a space on the interior of the valve housing 210. One or more openings 236 in the upper stem 230 below the upper stem skirt seal 232 allow communication between that interior space and an upper stem channel 238 through the upper stem. Fluids, gases, liquids, and/or solids in the respective space may escape through the upper stem channel 238.

The lower stem 220 may include one or more lower stem skirt seals 222 which seal against the interior wall of the valve housing 210 as illustrated in FIG. 4. While the lower stem skirt seals 222 illustrated in FIG. 4 may be used to form the necessary seal and create a space between the lower stem 220 and the upper stem 230, other seals or sealing devices may be used to accomplish the same purpose. The lower stem 220 may also include one or more lower stem legs 224 extending between the lower stem 220 and the valve housing 210. The lower stem legs 224 may prevent or limit the travel of the lower stem 220 within the valve housing 210. For example, once the lower stem legs 224 contact a bottom portion of the valve housing 210 the lower stem legs 224 may prevent further movement of the lower stem 220 and upper stem 230. In such a position, the valve system 200 is in an open position, allowing the contents of the container 100 to flow out of the container 100, into the valve system 200, and out through the upper stem channel 238. According to some embodiments of the invention, the lower stem 220 may be positioned above the ribs 250 of the valve housing 210.

According to various embodiments of the invention, the lower stem 220 may be pushed down over the ribs 250 of the valve housing 210 by movement of the upper stem 230. Pressure applied to the top of the upper stem 230 pushes the lower stem 220 downward toward the ribs 250 of the valve housing 210. As the lower stem skirt seal 222 meets the ribs 250, the ribs break the seal between the lower stem skirt seal 222 and the interior wall of the valve housing 210. Contents in the container 100 may escape from the container 100 through the break in the seal between the lower stem 220 and the valve housing 210 and into the interior space between the lower stem 220 and upper stem 230. The contents in this interior space may pass through the one or more openings 236 in the upper stem 230 and through the upper stem channel 238. When pressure on the upper stem 230 is released, pressure inside the container 100 may force the lower stem 220 off of the ribs 250, thereby re-sealing the valve system 200 and stopping the flow of contents from the container 100 through the upper stem 230. In a pressurized system, such as an aerosol system, the pressure of the contents of the container 100 may be sufficient to hold the valve system 200 in a closed position as illustrated in FIG. 4.

According to various embodiments of the invention, the valve housing 210, the lower stem 220, and the upper stem 230 may be made of plastic, metal, glass, a composite material, or any combination thereof.

Figure 5:
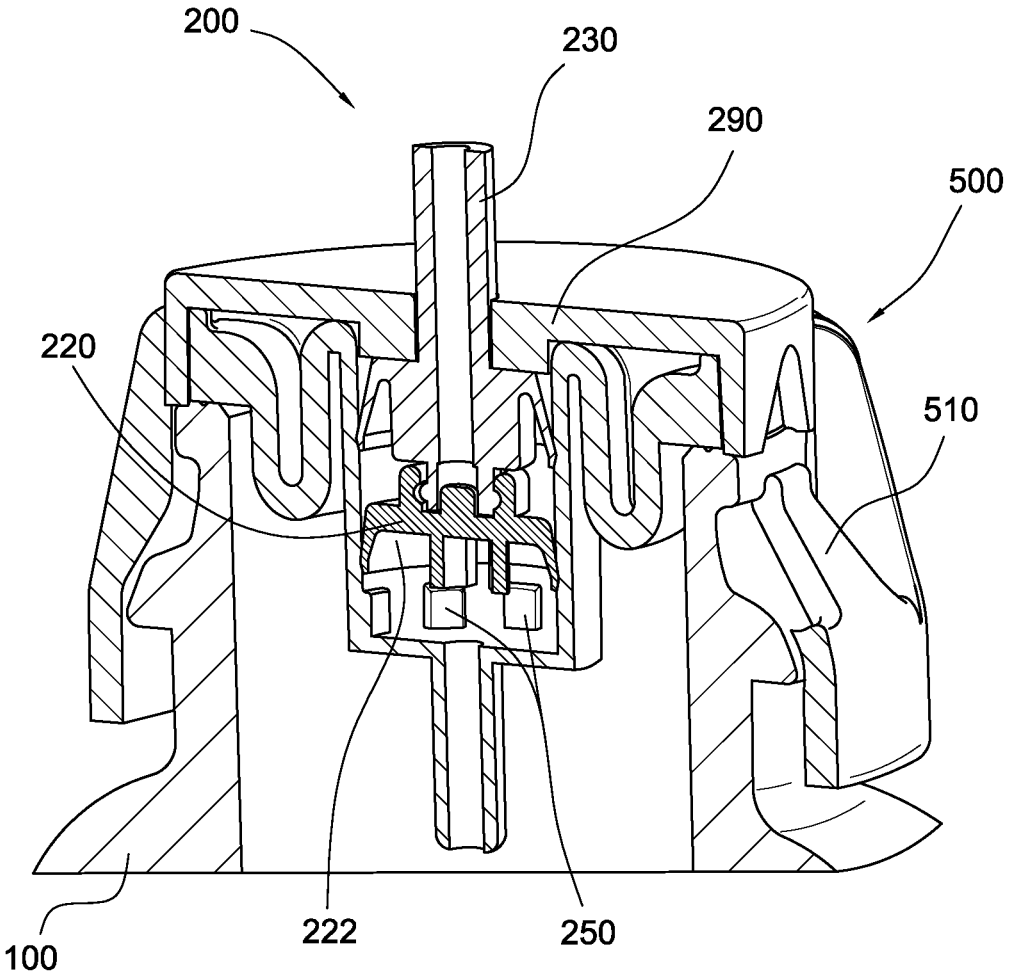
FIG. 5 illustrates a cross-sectional view of an alternate embodiment of a valve system according to embodiments of the invention attached to a container with a snap-fitment valve body system.

According to other embodiments of the invention, the valve housing may be incorporated into the valve body 500 as illustrated in FIG. 5. The valve housing 210 of FIG. 5 may be molded with the valve body 500 and the lower stem 220 and upper stem may be seated in the valve body 500 as illustrated. A top retainer 290 may be connected over the upper stem 230 to maintain the upper stem 230 and lower stem 220 in the valve body 500.

According to embodiments of the invention, the valve system 200 illustrated in FIG. 5 may operate in the same manner as that illustrated in FIG. 4.

According to various embodiments of the invention, the ribs 250 in the valve housings 210 or valve bodies 500 may be substituted with channels such that the channels form depressions in the valve housing 210 or valve body 500. The use of channels in the place of the ribs 250 allows contents of the container to pass through the channels into an interior space between the lower stem 220 and upper stem 230 when the lower stem skirt seal 222 passes over the channels. The use of channels rather than ribs 250 prevents repeated deformation of the lower stem skirt seal 222 over the use of the valve system 200 such that the lower stem skirt seal 222 may better retain its shape and seal the contents of the container 100 within the container when the lower stem 220 and upper stem 230 are not activated.

Figure 6:
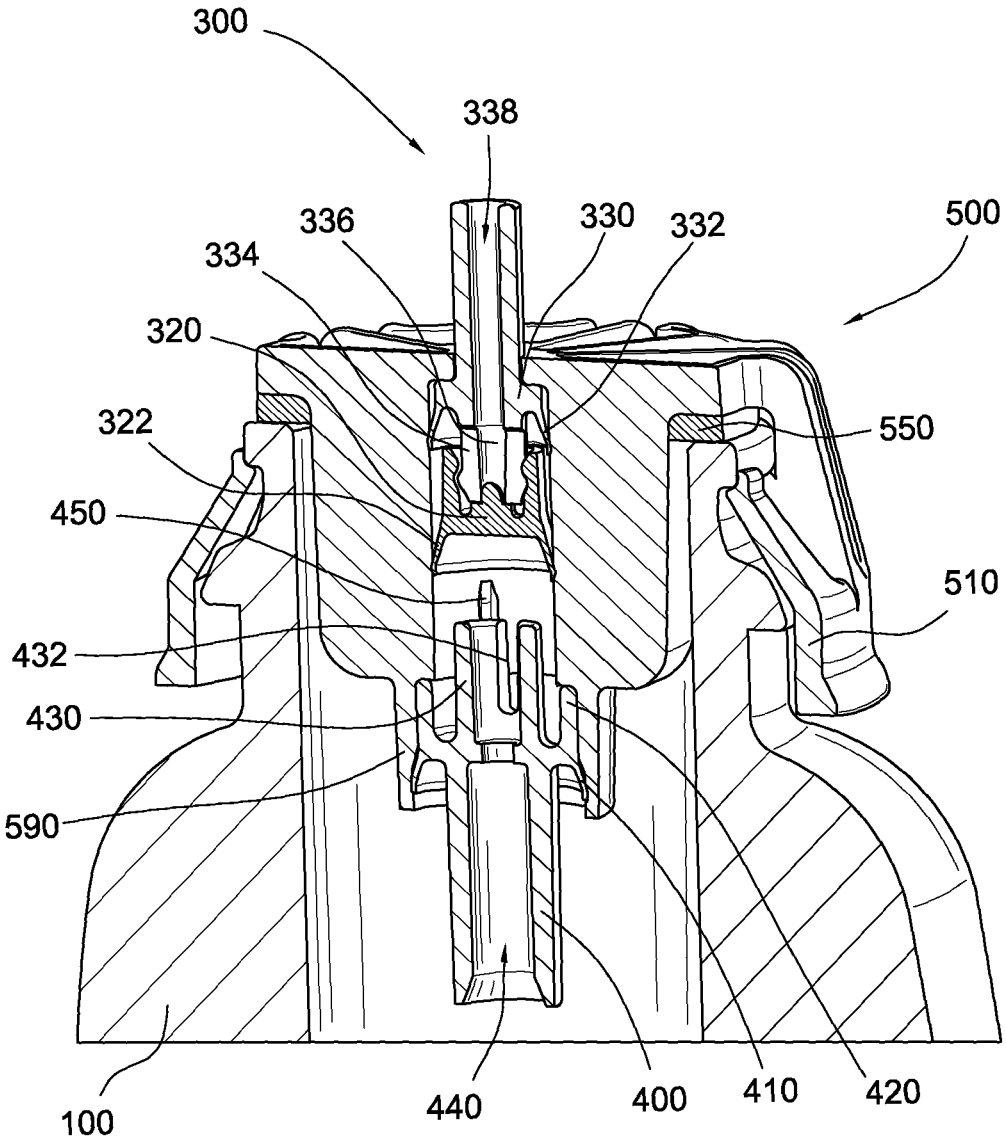
FIG. 6 illustrates a cross-sectional view of an alternate embodiment of a valve system according to embodiments of the invention attached to a container with a snap-fitment valve body system.

According to other embodiments of the invention, a valve system 300 may be configured as illustrated in FIG. 6. A valve body 500 incorporated into a valve system 300 as illustrated in FIG. 6 may be fitted to a container 100 as with other embodiments of the invention. One or more compression latches 510 may hold the valve body 500 on the container 100 when the contents of the container 100 are under pressure or not. In addition, a gasket 550 may be positioned between the valve body 500 and the container 100 as illustrated. The gasket 550 may seal or improve the seal between the valve body 500 and container 100. The gasket 550 may be bi-injected with the valve body 500 or may be a separate component that is added during assembly. The valve body 500 may also include a tube retainer opening 590. The tube retainer opening 590 may be configured to accept a tube retainer 400.

According to embodiments of the invention, a valve system 300 may include an upper stem 330, a lower stem 320 and a tube retainer 400 as illustrated in FIG. 6. The upper stem 330 may be positioned in a top portion of the valve body 500 and may extend through a hole in the valve body 500 as illustrated in FIG. 6. An upper stem skirt seal 332 may provide a seal between the upper stem 330 and an interior wall of the valve body 500. The upper stem 330 may be connected to or in contact with a lower stem 320 positioned in an interior space of the valve body 500 as illustrated in FIG. 6. For example, upper stem legs 334 may extend from the upper stem 330 and contact or mate with the lower stem 320. Openings 336 in the upper stem legs 334 may provide a pathway from an interior space of the valve body 500 into an upper stem channel 338.

The lower stem 320 may be positioned on an interior portion of the valve body 500. The lower stem 320 may include a lower stem skirt seal 322. The lower stem skirt seal 322 may provide a seal between the lower stem 320 and an interior wall of the valve body 500. The interior valve body 500 space defined between the lower stem skirt seal 322 and the upper stem skirt seal 332 may form a chamber through which product may pass.

A tube retainer 400 may be positioned in a tube retainer opening 590 in the valve body 500 as illustrated in FIG. 6. The tube retainer 400 may include a stop 430 having openings 432. The stop 430 may be configured to prevent the lower stem 320 from traveling further towards the tube retainer 400 when a force is applied to the upper stem 330 to activate the valve system 300. The openings 432 in the stop 430 may allow product to flow from the container 100 through the tube retainer channel 440 into an interior space of the valve body 500 between the tube retainer 400 and the lower stem 320. The tube retainer 400 may also include a first seal 420 for creating a seal between the valve body 500 and the tube retainer 400. A second seal 410, or alternative seal, may also exist between the tube retainer 400 and the valve body 500. For example, as illustrated in FIG. 6, the tube retainer includes both a first seal 420 and a second seal 410. While the seals may include any type of seal or other connection, such as a snap-fit connection, screw connection, snap connection or the like, the second seal 410 illustrated is a skirt seal which helps to prevent or minimize product or the contents of the container 100 from entering the valve body 500 through an entry other than the tube retainer channel 440.

A dip tube (not shown) may be assembled into the tube retainer channel 440 if desired and in accordance with conventional dip tube assembly practices.

According to some embodiments of the invention, the valve body 500 and valve system 300 may be attached to a container 100 containing pressurized contents. The pressure in the container 100 is exerted on the lower stem 320 closest to the tube retainer 440. The pressure on the lower stem 320 pushes the lower stem 320 upwards against the upper stem legs 334 of the upper stem 330, which in turn pushes the upper stem 330 against the valve body 500. When sufficient force is applied to the upper stem 330 to overcome the pressure from the pressurized contents in the container 100, the upper stem 330 pushes the lower stem 320 downwards such that the lower stem skirt seal 322 passes the one or more channels 450. Pressurized contents of the container 100 may pass through the one or more channels 450 past the lower stem skirt seal 322, through the openings 336 in the upper stem 330 and out the upper stem channel 338. Release of the force on the upper stem 330 removes the barrier to upward movement of the lower stem 320, allowing the lower stem 320 to be moved upwards until the lower stem skirt seal 322 is above the one or more channels 450, stopping the flow of the contents of the container through the valve system 300.

According to embodiments of the invention, a valve system 300 and valve body 500 may be assembled in a single unit for assembly to a container 100 in later processes. For example, a valve body 500 and valve system 200 as illustrated in FIG. 4 may be assembled by inserting an upper stem 230 or an upper stem 230 and lower stem 220 combination into the appropriate position in the valve body 500. If the upper stem 230 is inserted without the lower stem 220, the lower stem 220 may be inserted into the valve body 500 after the upper stem 230. The valve housing 210 may be inserted into the valve body 500 and secured in place using various methods, including but not limited to, by a snap fitment system. The upper stem 230 and lower stem 220 may be free moving between the interior of the valve body 500 and the interior of the valve housing 210 until the valve body 500 and valve system 200 are attached to a container 100 of pressurized contents or attached to a container 100 which is then filled with pressurized contents. Pressure in the container 100 to which the valve body 500 and valve system 200 is attached shall force the lower stem 220 and upper stem 230 into a position that prevents the escape of contents from the container 100 until the upper stem 230 is activated to push the lower stem skirt seal 22 over the ribs 250 or channels in the valve housing 210.

The embodiments of the invention illustrated in FIGS. 5 and 6 may also be assembled in a single unit for later assembly with a container 100. For example, the lower stem 220 and upper stem 230 illustrated in FIG. 5 may be positioned in the valve body 500 and the top retainer 290 applied. The combination may then be assembled with a container 100. Similarly, the upper stem 330 and lower stem 320 illustrated in FIG. 6 may be inserted into the valve body 500 followed by insertion of the tube retainer 400 into the valve body 500. The tube retainer 400 may keep the lower stem 320 and upper stem 330 from falling out of the valve body 500. The combination of parts may then be assembled with a container 100 or with a dip tube and a container 100.

According to various embodiments of the invention, the valve systems 200 and 300 may be made of all plastic parts. The parts of the valve systems 200 and 300 may be produced using molding techniques as known. Various plastics and/or resins may be used to produce the components of the valve systems 200 and 300.

In other embodiments of the invention, the valve system parts may be made of plastic, metal, composite, or other materials, or combinations thereof. In addition, one or more metal or plastic springs may be used in conjunction with the valve systems 200 and 300. For example, in the valve system 300, a spring may be positioned over the stop 430 between the tuber retainer 440 and the lower stem 320. The spring (not shown) may be compressed when the lower stem 320 is forced downward by a force applied to the upper stem 330 such that when the force on the upper stem 330 is released, the spring applies a force against the lower stem 320 to return the lower stem 320 into a position that prevents the transport of contents of the container past the lower stem seal 322. In this manner, a spring may assist with the closing of the valve system 300 and/or increase the amount of force required to activate or open the valve system 300.

Figure 7:
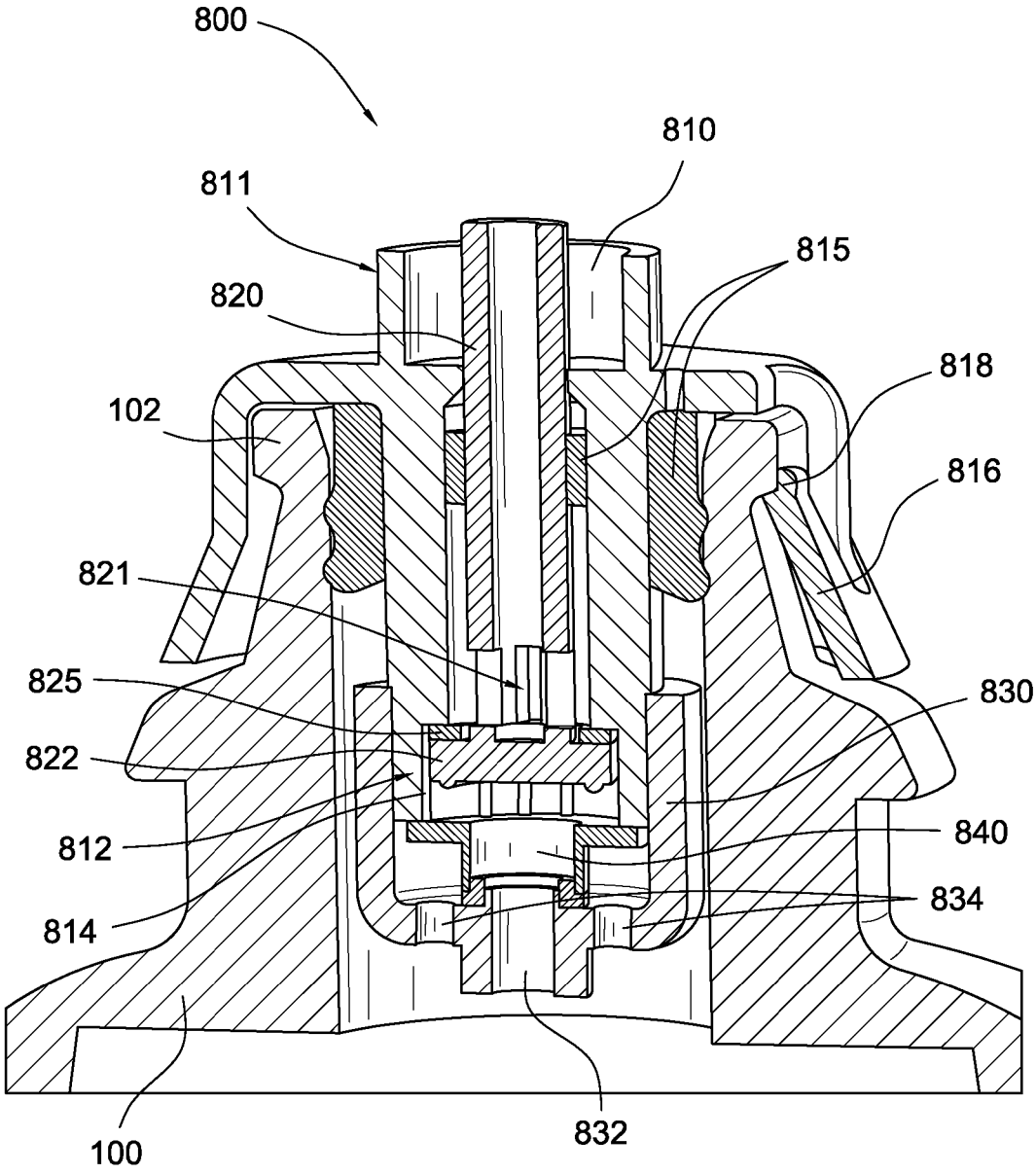
FIG. 7 illustrates a cross-sectional view of a valve system according to particular embodiments of the invention.

According to other embodiments of the invention, a valve system may include a valve body 810, a stem 820, a retainer 830, and a fill valve 840 as illustrated in the valve system 800 of FIG. 7.

According to some embodiments of the invention, the valve body 810 may be the same as or similar to the valve bodies illustrated in FIGS. 4 through 6. In some embodiments of the invention, the valve body 810 may include one or more fingers 818 or other projections on compression latches 816 which may snap onto a container 100 or fit with or work with a projection portion 102 of a container 100. A valve body 810 may also include one or more valve body seals 815. An inner valve body seal 815 may be positioned on an interior portion of the valve body 810 between the valve body 810 and a stem 820. An outer valve body seal 815 may also be positioned on the valve body 810 between the valve body 810 and an interior portion of the container 100. According to some embodiments of the invention, all or a portion of a valve body seal 815 may be bi-injected with the valve body 810. In other embodiments, all or a portion of the valve body seal 815 may be a component that is assembled with or to the valve body 810. While particular embodiments of the invention are shown with a single inner valve body seal 815 and a single outer valve body seal 815, it is understood that two or more inner or outer valve body seals 815 may be incorporated with various embodiments of the invention.

A valve body 810 may include a stem opening through which a stem 820 may extend from an interior portion of the valve body 810 outside the valve body 810. The valve body 810 may also include a stem seat portion 812. A portion of a stem 820 may fit within the stem seat portion 812 of the valve body 810 to form a valve in the valve system 800. In some embodiments of the invention, the stem seat portion 812 of the valve body 810 may be positioned at an end of the valve body 810 opposite that of the stem opening. The stem seat portion 812 may also include one or more passageways 814 or grooves.

A valve body 810 according to various embodiments of the invention may include a collar 811. The collar 811 may extend away from an opening in the valve body 810 into which a stem 820 may fit or be assembled. According to some embodiments of the invention, the collar 811 may circumscribe or surround a portion of the stem 820 assembled with the valve body 810. The collar 811 may prevent the stem 820 from being activated beyond a certain position by a user.

According to certain embodiments of the invention, the stem 820 may include one or more stem seals 825. In some embodiments of the invention a stem seal 825 may be a bi-injected stem seal 825 formed integrally with the stem 820 during a bi-injection molding process. In other embodiments of the invention, a stem seal 825 may be an additional component of the valve system 800 which is assembled to the stem 820 in any known manner. According to various embodiments of the invention, two or more stem seals 825 may also be used.

A stem 820 may also include one or more stem windows 821 providing a conduit from an interior portion of the stem 820 to an exterior portion of the stem 820. The stem 820 may also include a stem valve portion 822 seated in the stem seat portion 812. In some embodiments of the invention, a stem seal 825 may be bi-injected with the stem valve portion 822 of the stem 820.

A retainer 830, according to some embodiments of the invention, may be positioned in an opening of the container 100 as illustrated. The retainer 830 may include one or more product openings 832. The retainer 830 may also include one or more holes 834. According to some embodiments of the invention the retainer 830 may be configured to snuggly fit within a neck or other portion of the container 100. According to other embodiments of the invention, the retainer 830 may be assembled with or fitted to the valve body 810 and positioned in an interior portion of a container 100 to which the valve system 800 is attached. For example, the retainer 830 illustrated in FIG. 7 may be attached, assembled, or otherwise in communication with the valve body 810 such that a portion of the valve body 810 extends into an interior portion of the retainer 830. In other embodiments, the retainer 830 may fit into an interior portion of the valve body 810 and may form a portion of the stem seat portion 812 of the valve system 800.

According to certain embodiments of the invention, a fill valve 840 may be positioned between the valve body 810 and the retainer 830 as illustrated in FIG. 7. The fill valve 840 may form a seal with the valve body 810 and with the retainer 830 to create a path from an interior of the valve body 810 to the one or more product openings 832 of the retainer 830. According to some embodiments of the invention, the fill valve 840 may include a flexible or elastomeric seal member and a seat member wherein the seat member is positioned to mate with, attach to, or communicate with the product openings 832 of the retainer 830.

In some embodiments of the invention, the fill valve 840 may include a flexible material, such as GLS Versaflex OM9-801N, and the seal between the fill valve 840 and the valve body 810 may be broken, allowing a liquid or gas being introduced into a container 100 through the stem 820 to pass outside of the fill valve 840 into a compartment between the interior of the retainer 830 and the outside of the fill valve 840 and through the one or more holes 834 into the container 100.

According to various embodiments of the invention, the valve system 800 may be used as a valve for aerosol devices or other pump mechanisms. Further, the valve system 800 may be used to fill containers 100 with a product and a propellant in addition to being used to distribute or disperse the product using the propellant. For example, FIGS. 1 through 3 illustrate various configurations of use of the valve system 800.

The valve system illustrated in FIG. 7 is in a closed position. In this position, the valve body 810 is connected to the container 100. According to some embodiments, the fingers 818 or compression latches 816 interact with or secure the valve body 810 to the container 100. An outer valve body seal 815 may provide a seal between the valve body 810 and an interior portion of the container 100. An inner valve body seal 815 may provide a seal between the stem 820 and an inner portion of the valve body 810 as illustrated. The stem 820 may move relative to the inner valve body seal 815 which may maintain a seal with the stem 820 during such movement. A stem valve portion 822 of the stem 820 may include a stem seal 825 positioned between the stem valve portion 822 and the valve body such that a seal is formed between the stem valve portion 822 and the valve body 810. In some instances, the stem seal 825 may form a seal with a portion of the stem seat portion 812 of the valve body 810. The fill valve 840 may form a seal between the lower portion of the valve body 810 and the retainer 830. In this closed position, gas and/or fluid may not pass through the valve system 800 to or from the container 100.

Figure 8:
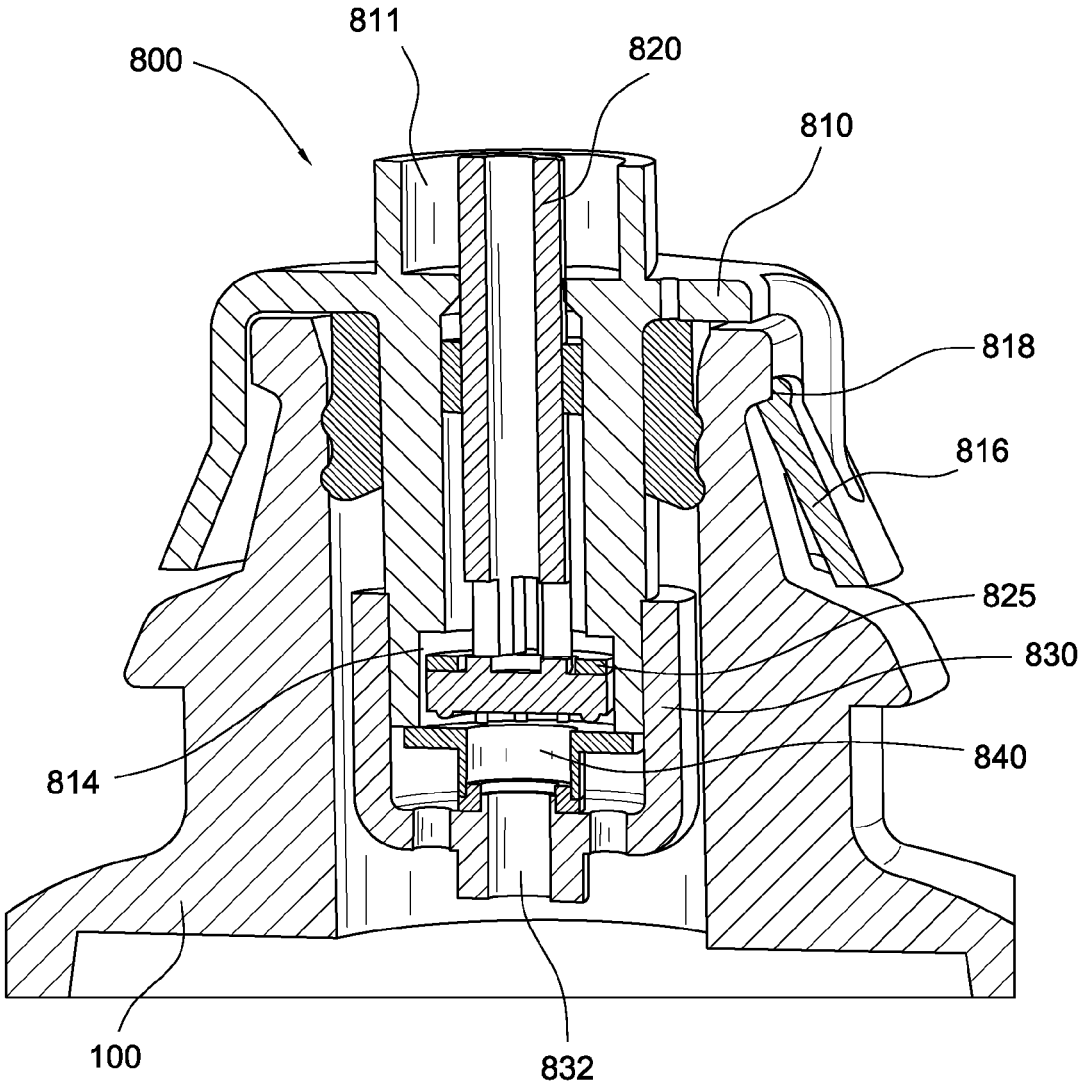
FIG. 8 illustrates a cross-sectional view of a valve system according to particular embodiments of the invention.

FIG. 8 illustrates a valve system 800 according to certain embodiments of the invention in an open position which may be used to evacuate product from within the container 100 or to fill the container 100 with a product. As illustrated, the stem 820 is partially depressed, breaking or opening a gap between the stem seal 825 and the valve body 810. When the stem 820 is partially depressed, a pathway is opened between an interior portion of the stem 820, through one or more stem windows 821, into one or more passageways 814, into an interior space of the fill valve 840, and through the one or more product openings 832 into the container 100.

During filling processes, product may be introduced from outside the valve system 800 into the interior of the stem 820 while the stem 820 is partially depressed as illustrated in FIG. 8. When product is introduced in this manner, the product will flow through the stem 820 and into the container 100 following the pathway described. According to some embodiments of the invention, the collar 811 of the valve body 810 may facilitate the filling of a container 100 using the valve system 800. For instance, filling machinery may be keyed or otherwise configured to seal around the collar 811 during filling such that product may be introduced into the stem 820, and in some instances, under pressure.

Similarly, during evacuation of product from the container 100 to the environment, the stem 820 may be partially depressed as illustrated in FIG. 8, creating at least one pathway by which product in the container 100 may escape through the valve system 800. In some instances, a product in the container 100 may only flow out through the one or more pathways if forced to do so by pressure, such as by pressure created by an aerosol or by other pressure introduced to the container.

In the open position, the fill valve 840 may maintain a seal with the valve body 810. The seal between the fill valve 840 and the valve body 810 may prevent product from flowing into an interior portion of the retainer 830.

Figure 9:
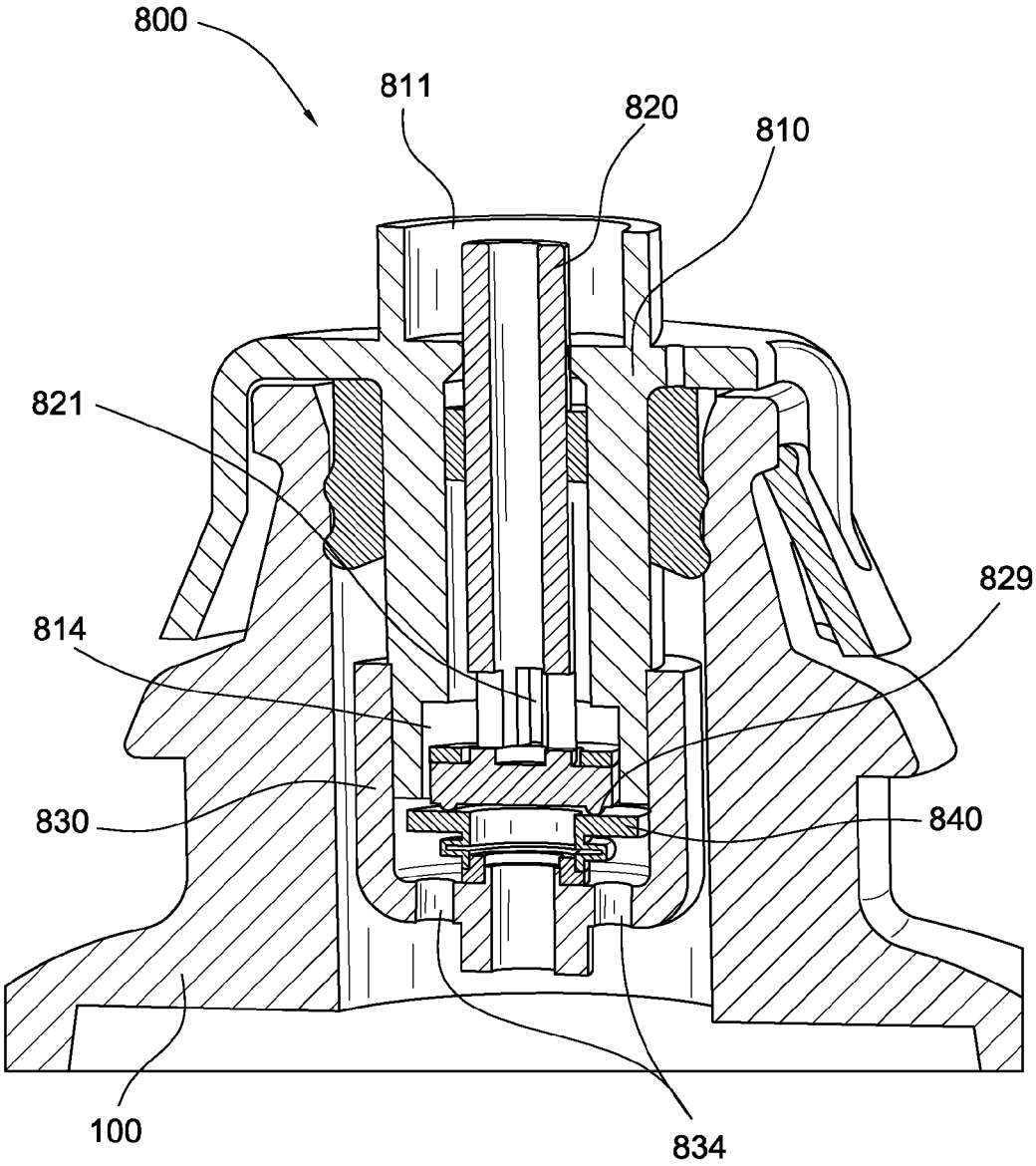
FIG. 9 illustrates a cross-sectional view of a valve system according to particular embodiments of the invention.

FIG. 9 illustrates the valve system 800 in a pressurization configuration according to various embodiments of the invention. As illustrated, the stem 820 may be depressed such that it contacts the fill valve 840, breaking the seal, or opening a flow channel, between the fill valve 840 and the valve body 810. The stem 820 may include one or more stem projections 829 or annular rings which contact the fill valve 840 in this depressed position. The contact between the stem projections 829 and the fill valve 840 may form a seal preventing gas or fluid flowing through the stem from entering an interior portion of the fill valve 840. Instead, any gas or fluid passing through the stem 820, through the stem windows 821, and through one or more passageways 814 flows through the open seal between the valve body 810 and the fill valve 840, into an interior portion of the retainer 830. Space between the edges of the fill valve 840 and the interior walls of the retainer 830 allows gas or fluid to pass through the retainer 830 and through the one or more holes 834 into the container 100.

According to various embodiments of the invention, the pressurization position illustrated in FIG. 9 may be used to pressurize the interior of the container 100 or to introduce a gas or liquid into the container 100. In some embodiments of the invention, a user may not be able to depress the stem 820 to the position illustrated in FIG. 9 due to the presence of the collar 811 of the valve body 810. As shown, the stem 820 is depressed below the upper level of the collar 811. Filling or pressurization machinery may be configured to mate with the collar 811 and depress the stem 820 past the upper level of the collar 811, which may allow a gas or liquid to be introduced into the container 100 as described.

In some embodiments of the invention a user may be allowed to depress the stem 820 past the top portion of the collar 811, releasing product from within the container 100 using the path shown in FIG. 9.

According to various embodiments of the invention, a valve system 800 may be attached to a container 100 and the container 100 may be filled through the valve system 800. For example, a valve system 800 may be attached to a container 100 as illustrated in FIG. 7. The stem 820 of the valve system 800 may be partially depressed as illustrated in FIG. 8 and a product may be introduced through the stem 820 and into the container 100. The stem may be further compressed as illustrated in FIG. 9 and a pressurizing agent may be introduced into the stem 820 and into the container 100. According to certain embodiments of the invention, when a pressurizing agent is being introduced into the container 100 as illustrated in FIG. 9, product in the container 100 will not be able to escape through the product openings 832 because of the seal formed between the fill valve 840 and the stem 820. In this manner, a container 100 may be filled with a product and then pressurized to create an aerosol dispenser. Product may be dispensed from a pressurized container 100 by depressing the stem 820 as illustrated in FIG. 8. Product and pressurizing agent may escape the container 100 when the stem 820 is in the position illustrated in FIG. 8.

In some embodiments of the invention, a product bag may be attached to the retainer such that the product opening 832 communicates with the product bag. Product filled through the valve system 800 fills the bag. A pressurizing agent filled through the valve system 800 may fill in space between the product bag and the container 100 walls, pressurizing the bag such that product may be dispensed through the valve system 800 when the stem 820 is depressed as illustrated in FIG. 8.

Figure 10:
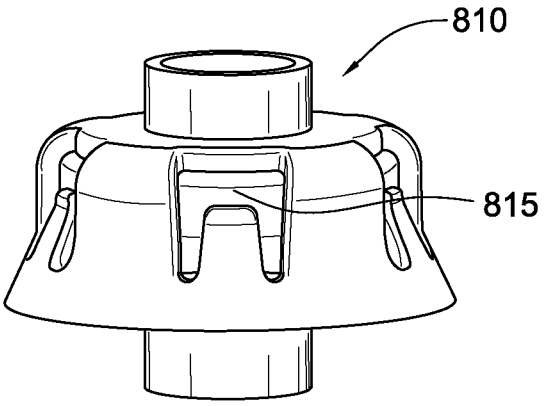
FIG. 10 illustrates a valve body according to particular embodiments of the invention.

FIG. 10 illustrates a valve body 810 and valve body seals 815 according to particular embodiments of the invention. The valve body 810 may be made of acetal and the valve body seals 815 may be made of a material such as GLS Versaflex OM89-801N. Other materials may also be used.

Figure 11:
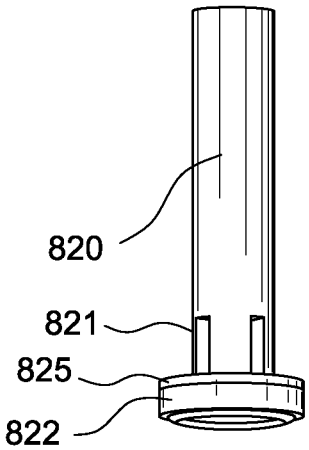
FIG. 11 illustrates a stem according to particular embodiments of the invention.

FIG. 11 illustrates a stem 820 according to various embodiments of the invention. The stem 820 may include stem windows 821, a stem seal 825, and a stem valve portion 822. The stem 820 may be made of polypropylene or other suitable material. The stem valve seal 825 may be made from GLS Versaflex OM9-801N. Other materials may also be used.

Figure 12:
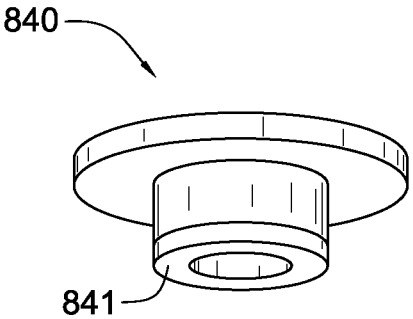
FIG. 12 illustrates a fill valve according to particular embodiments of the invention.

FIG. 12 illustrates a fill valve 840 according to various embodiments of the invention. The fill valve 840 may include a seat 841. The seat 841 may fit with or mate to a retainer 830 or may provide improved handling capabilities in automatic assembly processes. The fill valve 840 may be made of GLS Versaflex OM9-801N and the seat 841 may be made of polypropylene or other suitable material. Other materials may also be used.

Figure 13:
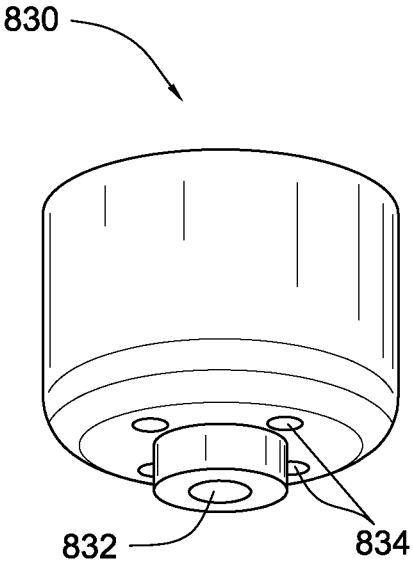
FIG. 13 illustrates a retainer according to particular embodiments of the invention.

FIG. 13 illustrates a retainer 830 according to some embodiments of the invention. The retainer 830 may be made of polyethylene or other suitable material.

According to various embodiments of the invention, the valve system 800 may be made of any desirable material or combination of materials. In some embodiments the valve system 800 may include all plastic materials. In other embodiments, plastic materials may be mixed with glass, metal, composites, or other products and molded or otherwise shaped to create the valve system 800. While plastic materials are desirable as materials for constructing the valve system 800, other materials may be used as desired.

The snap fitment systems and valve systems according to various embodiments of the invention may be attached to an aerosol container to provide an aerosol disbursement system. The aerosol disbursement system may be used to distribute any aerosol, including, air care formulas, hair care formulas, fragrances, or other formulas.

While particular embodiments of the invention have been described with respect to aerosol bottles and containers, it is understood that various embodiments of the invention may be adapted and used with other bottles and containers. For example, embodiments of the invention may be used to attach closures, pumps, triggers, or other devices to other pressurized containers. In addition, embodiments of the invention may be use to attach closures, pumps, triggers, or other devices to non-pressurized containers and bottles as well.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A dispenser, comprising:
- a container having an opening;
- a flange on an outer surface of the container;
- a valve body positioned on the container wherein the valve body comprises:
  - an interior cup positioned at least partially inside the container opening;
  - an exterior skirt positioned at least partially outside the container opening;
  - a valve body lip between the interior cup and the exterior skirt; and
  - at least one compression latch mated with the flange of the container, wherein the at least one compression latch comprises:
    - a compression latch body extending upwardly from a base portion of the exterior skirt to a termination at a top portion; and
    - at least one finger extending off a back side of the compression latch body; and
- a valve supported by the valve body.

2. The dispenser of claim 1, wherein a joint between the at least one finger and the top portion creates and angled latch area.

3. The dispenser of claim 1, further comprising at least one gasket positioned between the valve body and the container.

4. The dispenser of claim 3, wherein the at least one gasket comprises a gasket bi-injected with the valve body.

5. The dispenser of claim 1, wherein the valve body comprises a single molded plastic component.

6. The dispenser of claim 1, wherein the valve body comprises a molded plastic component and a bi-injected gasket.

7. The dispenser of claim 1, wherein the valve further comprises:
- a valve housing fit into the valve body and extending at least partially into the container;
- an upper stem positioned at least partially in an interior space of the valve housing;
- a lower stem within the interior space of the valve housing and in communication with the upper stem; and at least one rib on an interior wall of the valve housing.

8. The dispenser of claim 7, further comprising at least one valve housing latch and at least one latch in the valve body wherein the at least one valve housing latch and the at least one latch in the valve body are connected by snap-fitment.

9. The dispenser of claim 7, further comprising at least one crush seal between the valve housing and the valve body.

10. The dispenser of claim 7, wherein the valve housing further comprises a tube connector in communication with an interior portion of the valve housing and an interior portion of the container.

11. A dispenser, comprising:
- a container having an opening;
- at least one flange on the container;
  - a valve body of one piece unitary construction at least partially positioned in the container opening, the valve body comprising:
  - a stem opening;
  - a stem seat portion positioned at an end of the valve body opposite the stem opening;
  - at least one passageway in an interior portion of the valve body; and
  - a collar extending away from the stem opening;
  - a stem positioned in an interior portion of the valve body and extending at least partially through the stem opening and past the collar, the stem comprising:
  - at least one stem window;
  - a stem valve portion moveably seated in the stem seat portion;
- a retainer positioned in the opening of the container and fitted to the valve body, the retainer comprising:
  - at least one product opening;
  - at least one hole; and
- a fill valve positioned between the retainer and the valve body.

12. The dispenser of claim 11, further comprising at least one stem seal.

13. The dispenser of claim 11, further comprising at least one stem projection on a portion of the stem valve portion extending toward the fill valve.

14. The dispenser of claim 11, wherein the stem valve portion further comprises at least one bi-injected stem seal along a portion of the stem valve portion.

15. The dispenser of claim 11, wherein the fill valve further comprises a fill valve made of a flexible elastomeric material.

16. The dispenser of claim 11, wherein the fill valve further comprises a seat member in communication with the at least one product opening.

* * * * *